United States Patent [19]

Bonassi

[11] Patent Number: 4,815,710

[45] Date of Patent: Mar. 28, 1989

[54] DEVICE FOR ADJUSTING THE SPACED RELATION BETWEEN THE CHEEKS OF A SHEET-NIPPING SHEAVE ASSOCIATED TO A WINCH; PARTICULARLY FOR NAUTICAL USES

[76] Inventor: Luciano Bonassi, Via Filippo Reina 33, 21047 Saronno (VA), Italy

[21] Appl. No.: 52,732

[22] Filed: May 20, 1987

[30] Foreign Application Priority Data

Aug. 1, 1986 [IT] Italy ..... 21367 A/86

[51] Int. Cl.[4] ..... B66D 1/30

[52] U.S. Cl. ..... 254/371

[58] Field of Search ..... 254/221, 325, 326, 334, 254/335, 342, 344, 354, 371, 372, 901, 902, 390; 226/190, 174; 242/118.5; 474/10, 19

[56] References Cited

U.S. PATENT DOCUMENTS

| | | | |
|---|---|---|---|
| 2,739,767 | 3/1956 | Dunkelberger et al. | 242/84.5 P X |
| 2,928,265 | 3/1960 | Askren | 242/221 X |
| 3,559,937 | 8/1971 | Carter | 254/354 X |
| 3,968,953 | 7/1976 | Guangorena | 254/371 X |
| 4,225,118 | 9/1980 | Ottemann | 254/371 X |
| 4,341,372 | 7/1982 | Sugioka | 254/371 X |
| 4,369,952 | 1/1983 | Kurling | 254/371 X |
| 4,386,760 | 6/1983 | Hutton | 254/371 |
| 4,453,701 | 6/1984 | Huggett | 254/371 |
| 4,570,869 | 2/1986 | Tsuji | 242/118.5 X |

*Primary Examiner*—Stuart S. Levy
*Assistant Examiner*—Joseph J. Hail, III
*Attorney, Agent, or Firm*—Michael J. Striker

[57] ABSTRACT

A device for adjusting the spaced relation between the cheeks of a sheet nipping sheave as used on winches, particularly for nautical applications, of the type comprising a sheet winding drum (2) with a sheet nipping sheave overlying the drum. The sheet nipping sheave has a lower cheek and a movable upper cheek. The movable cheek has a tubular connecting part provided with internal radially extending projections arranged to engage with corresponding recesses offset in height and formed on the sidewall of a collar which is fastened to the drum. A spacer spring is provided between the upper cheek and the drum.

8 Claims, 2 Drawing Sheets

DEVICE FOR ADJUSTING THE SPACED RELATION BETWEEN THE CHEEKS OF A SHEET-NIPPING SHEAVE ASSOCIATED TO A WINCH; PARTICULARLY FOR NAUTICAL USES

BACKGROUND OF THE INVENTION

This invention relates to a device for adjusting the spaced relation between two cheeks of a sheet-nipping sheave connected to a winch, particularly for nautical uses, in order to enable sheets of different diameters to be worked on the same sheave.

It is known that a winch for nautical uses is mainly intended to serve as a means for hauling a sheet taut aboard sailboats.

This type of a winch generally comprises a stationary framework having means for attaching the winch to a point of utilization, a sheet winding drum operated by a gear train through a feed shaft that is rotated, for example, by means of a manoeuvring crank which can be fitted axially of the winch, a sheet-nipping sheave connected with the drum, the sheave defining a groove for a sheet to be nipped therein and caused to turn in a taut state, and guide means for guiding the sheet in its path from the drum to the sheet-nipping sheave and vice versa.

SUMMARY OF THE INVENTION

It is an object of the invention to provide a device simple and inexpensive for enabling a groove in a sheet-nipping sheave to be adjustable so that it can fit a broad range of diameters of sheets to be worked.

The device according to the invention comprises a winch which includes a fixed framework, a sheet winding drum having a flat annular plate carried at the top thereof, a fixed support for a sheet nipping sheave, which support is connected to the fixed winch framework and has a cylindrical body around which a sheet nipping sheave is arranged, the sheet nipping sheave having a lower cheek and an upper cheek which is axially movable in relation to the lower cheek. The device is further provided with a collar member between the sheave and the cylindrical body of the sheave support, said collar member being rigidly secured to the winch drum and having recesses formed at different levels on a sidewall thereof, these recesses being able to engage with at least one projection internally provided on the upper cheek. A spacer spring is arranged between the upper cheek and the annular plate secured to the drum.

The recesses on the sidewall of the collar member are preferably in the form of serrations or saw-teeth which are relatively offset in a direction of height, and the projection on the upper cheek is such as to fit the profile of said teeth exactly.

Thus, the upper cheek can be snappingly turned in one sense and subsequently turned down in the other sense to bring the projection provided thereon into engagement with one of the teeth on the collar thereby to adjust the spaced relation between the two sheave cheeks. Engagement of the teeth on the collar with the projection on the upper cheek is ensured by said spacer spring.

The device of the invention also includes means for removing the difficulties that could arise as a result of the fact that the spaced relation between the cheeks is inadvertently chosen by the user so that it is slightly smaller than the diameter of a sheet to be worked. In this case, in fact, if the sheet does not succeed in reaching the bottom of the sheave groove, and though the winch may appear to operate satisfactorily, the winch and the sheet will be subjected to differentiated stresses due to the sheet running at different velocities on the drum and the sheave respectively. More particularly, the sheave will tend to take more sheet than the drum is capable to deliver to it with the risk of the sheet being ruptured.

In accordance with the invention, the lower cheek of the sheave is not rigidly secured to the drum but is made free to turn so that when the stress on the sheet is in excess, the lower cheek will turn in the direction opposite to that of the winding to draw the sheet in that direction thereby to cause the sheet to run in the sheave at a velocity consistent with that on the drum.

Further features and advantages of the invention will appear from the following detailed description of one embodiment thereof shown by way of a non restrictive example by the accompanying drawings.

DETAILED DESCRIPTION OF THE INVENTION

Figure 1:
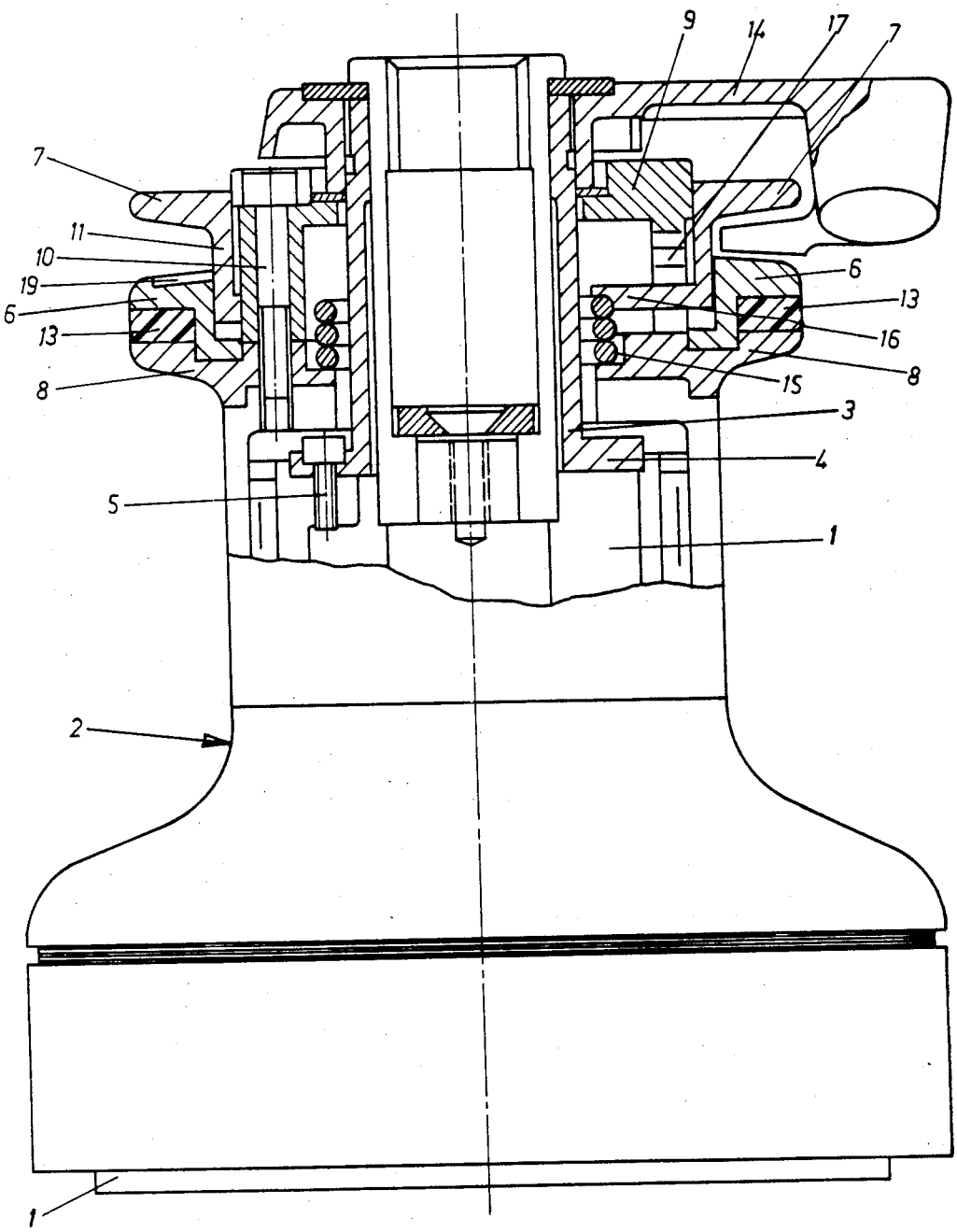
FIG. 1 is a view partly cut away and partly in axial section of a winch embodying the invention.

With reference to the drawings, and particularly to FIG. 1, thre is shown a winch comprising, in a known manner, a stationary framework 1 having gearing means housed therein, which gearing means are able, through a shaft that can be operated by means of the square pin of a crank, to drive a sheet winding drum 2 in rotation. Since the above mentioned driving means are known per se, they are not shown in the drawings nor will be further described herein after.

Thus, the following description will be directly in connection with the most specific subject matter of the invention, namely the sheet nipping sheave embodying thereof.

A support 3 is provided for mounting the sheet nipping sheave and has a middle cylindrical portion and a flange 4 by which the support 3 is fastened to the winch framework 1 with the aid of screws 5.

The sheet nipping sheave surrounds the support 3 and comprises a lower cheek 6 and an upper cheek 7, the two cheeks being held apart from each other by a helical spring 15, the spring acting between the upper cheek 7 and an annular plate 8 which is integral with the drum 2 or, in any way, firmly secured thereto.

Arranged around the support 3 is also a collar member 9 which is rigidly secured to the plate 8 of drum 2 by means of screws 10.

Figure 2:
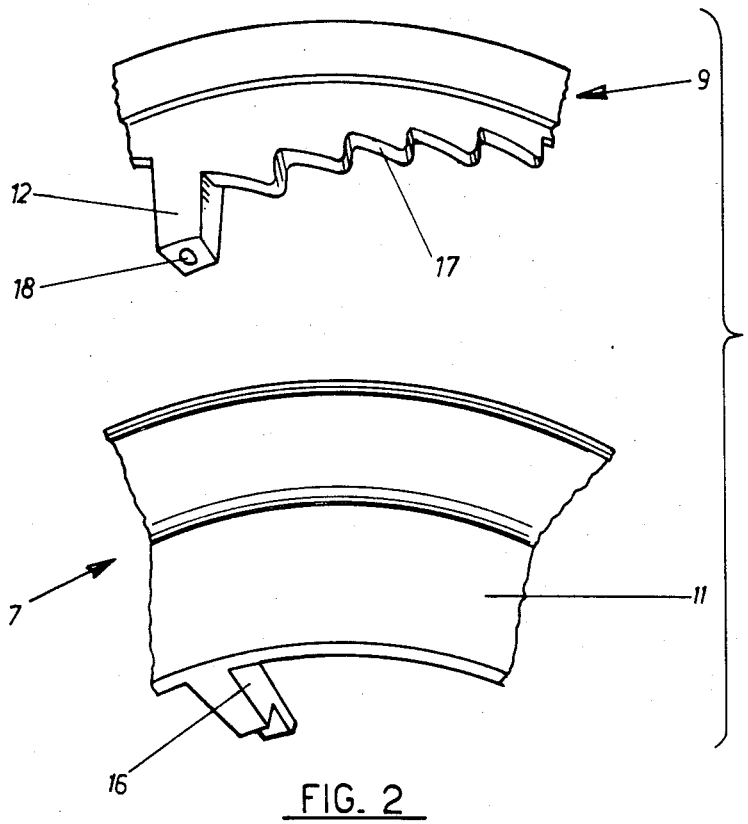
FIG. 2 is an exploded and perspective view showing some of the elements in FIG. 1 which have particular connection with the device according to the invention.
Figure 3:
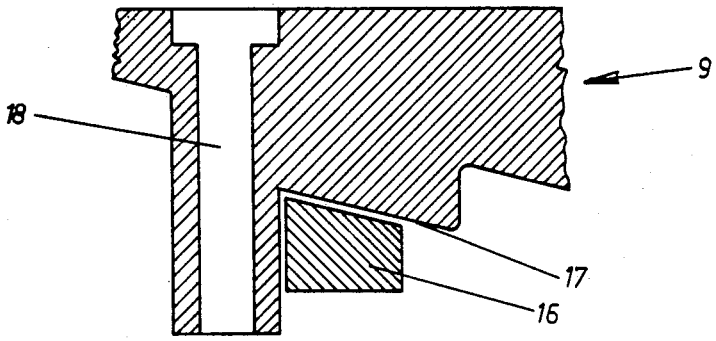
FIG. 3 is a sectional view schematically showing the engagement of the elements in FIG. 2 with one another.

The upper cheek 7 has a tubular connecting part 11 provided with internal radially extending projections 16 (see also FIGS. 2 and 3) which are able to fit into recesses 17 formed in the sidewall of said collar member 9 and being best seen in FIGS. 2 and 3.

The recesses 17 are preferably in the shape of saw-teeth which are relatively offset in height on the sidewall of the collar 9. In FIG. 2 only one set of said recesses or teeth 17 are shown but it is to be intended that a plurality, such as three, of like sets may provided around the circumference of the sidewall of collar 9. In a corresponding manner, the tubular comprising part 11 of the upper cheek 7 will have as many projections 16 as are the sets of teeth 17 on the collar 9.

The sequences of teeth 17 are spaced apart from each other by intervening vertically extending projections 12 having through-holes 18 formed therein for receiving the screws 10 by which the collar 9 is fastened.

As shown in the section view in FIG. 3, the projections 16 are shaped so as to exactly fit the profile of serrations 17.

Operation of the device is as follows.

When the winch is assembled as shown in FIG. 1, the projections 16 on the tubular connecting part 11 of the cheek 17 are in engagement with corresponding teeth 17, all of which are at the same level on the sidewall of collar 9, the engagement being ensured by action of the spacer spring 15 interposed between the cheek 7 and the plate 8.

In order to increase the space between the cheeks 6 and 7 it is sufficient to turn in a corresponding direction the upper cheek 7, the projections 16 of which will slide over the profile of teeth 17 by successive advancing steps, due to the pressure exerted by the spring 15, to come into engagement with a further set of teeth 17 (all of which are at the same level) on collar 9.

On the other hand, in order to reduce the spaced relation between the cheeks, the upper cheek 7 is first moved down against the force of the spring 15 and then turned in an opposite direction to the preceding one to release it at a desired position.

According to a further feature of the invention, the lower cheek 6 is not locked to the winch drum 2 but is arranged so as to be free to turn with respect to it, as viewed in FIG. 1.

Obviously, if the space between the sheave cheeks is chosen so that the sheet "grips" the sheave bottom, i.e. the outer surface of the tubular connecting part 11 the diameter of which is the same as that of the drum 2, and, at the same time, the sheet has an adequate pressure exerted thereupon by the two cheeks, no relative rotation of the lower cheek and the drum 2 will occur so that these latter will turn with the upper cheek 7 as one unit.

However, should the operator inadvertently choose an opening size of the lower cheek which is smaller than the diameter of a concerned sheet, such that this latter will not "grip" the sheave bottom, the sheave would have tendence to draw more sheet than the drum 2 is able to deliver to it, as a result of which differentiated stresses are induced on both the winch and the sheet with the risk of the sheet being ruptured in the region of its travel from the drum to the sheave.

Due to the provision of a lower cheek 6 arranged to be free, this lower cheek will be able, under the above circumstances, to turn slightly in the direction opposite to the direction of winding so as to draw the sheet in that direction thereby to cause the sheet to run over the sheave at a velocity consistent with that over the drum.

In order to facilitate said relative rotation of the cheek 6 and the drum 2, in view of the high pressure occurring between these elements when in operation, the cheek 6 is made from an antifriction material such, for example, as Nylon. The same cheek 6 has a toothing 19 provided on the top face thereof, which toothing is effective in promoting the driving of the sheet both in the winding direction and the reverse direction under the circumstances as referred to above.

For completeness of the description, it is to be noted that shown in FIG. 1 of the drawings is a ring 13 interposed between the lower cheek 6 and the plate 8, as well as a covering plate 14.

Moreover, means of a more or less known type are arranged between the elements 13 and 14 and are intended for facilitating passage of the sheet from the drum 2 to the groove in the sheave and its going out of the sheave.

As is apparent, the invention is not restricted to the specific embodiment that has been described herein before and shown in the accompanying drawings and many variations may be thought by those skilled in the art without departing from the spirit and scope of the invention.

I claim:

1. In a combination of a winch, particularly for nautical applications comprising a stationary framework (1) having at a top thereof a cylindrical support (3), a sheet winding drum (2) carrying in an overlying position, a sheet nipping sheave which comprises a lower cheek (6) and an upper cheek (7), the upper cheek (7) being axially movable with respect to the lower cheek, with an adjusting device for adjusting a spaced relationship between said upper cheek and said lower cheek of said sheet nipping device, the adjusting device comprising a collar member (9) rigidly locked to the drum, said upper cheek (7) having a tubular connecting portion (11) provided with internal radially extending projections (16) which are able to engage in corresponding recesses (17) formed at different levels in height on a side-wall of said collar member (9), the collar member (9) surrounding said cylindrical support (3); and a spacer spring (15) provided between the upper cheek (7) and the drum (2), said recesses (17) being shaped as saw-teeth which are relatively offset from each other in height, the projections (16) fitting a profile of said saw-teeth.

2. The device according to claim 1, wherein a plurality of identical sequences of said recesses (17) are provided, said sequences being provided in succession over a circumference of the sidewall of the collar (9), the projections (16) on the upper cheek (7) being the same in number as said sequences.

3. The device according to claim 2, wherein said sequences of recesses on the collar (9) are defined by intervening, vertically extending protrusions (12), said protrusions (12) having through-holes (18) formed therein for passage of screw means (11) by which the collar (9) is fastened to the drum (2).

4. The device according to claim 2, wherein said lower cheek (6) is rotatably mounted with respect to the drum (2).

5. The device according to claim 1, wherein said lower cheek (6) is rotatably mounted with respect to the drum (2).

6. The device according to claim 5, wherein a toothing (19) is provided on an upper face of the lower cheek (6).

7. The device according to claim 6, wherein the lower cheek (6) is made of Nylon. 'pg,17

8. In a combination of a winch, particularly for nautical applications comprising a stationary framework (1) having at a top thereof a cylindrical support (3), a sheet winding drum (2) carrying in an overlying position a sheet nipping sheave which comprises a lower cheek (6) and an upper cheek (7), the upper cheek (7) being axially movable with respect to the lower cheek, with an adjusting device for adjusting a spaced relationship between said upper cheek and said lower cheek of said sheet nipping device, the adjusting device comprising a collar member (9) rigidly locked to the drum, said upper cheek (7) having a tubular connection portion (11) provided with internal radially extending projections (16) which are able to engage in corresponding recesses (17) formed at different levels in height on a side-wall of said collar member (9), the collar member (9) surrounding said cylindrical support (3); and a spacer spring (15) provided between the upper cheek (7) and the drum, said lower cheek being rotatably mounted with respect to said drum.

* * * * *